US010897989B1

(12) United States Patent
Mink

(10) Patent No.: US 10,897,989 B1
(45) Date of Patent: Jan. 26, 2021

(54) SLIDING BEDSIDE TRAY

(71) Applicant: Judy Mink, Melbourne, FL (US)

(72) Inventor: Judy Mink, Melbourne, FL (US)

( * ) Notice: Subject to any disclaimer, the term of this patent is extended or adjusted under 35 U.S.C. 154(b) by 0 days.

(21) Appl. No.: 16/653,371

(22) Filed: Oct. 15, 2019

(51) Int. Cl.
*A47B 23/00* (2006.01)
*A47B 13/08* (2006.01)
*A47B 23/04* (2006.01)

(52) U.S. Cl.
CPC ..... *A47B 23/001* (2013.01); *A47B 13/081* (2013.01); *A47B 13/088* (2013.01); *A47B 23/046* (2013.01)

(58) Field of Classification Search
CPC ..... A47B 23/00; A47B 23/01; A47B 13/081; A47B 13/046; A47B 45/00; A47B 23/001; A47B 23/046
USPC ..... 108/49, 102, 90, 143, 61, 65, 73
See application file for complete search history.

(56) References Cited

U.S. PATENT DOCUMENTS 794,809 A * 7/1905 Marsh ..... 108/143
1,398,611 A * 11/1921 Van Alstyn ..... A47B 21/045 211/45
2,692,806 A * 10/1954 Grace ..... A47B 23/02 108/143
3,680,158 A * 8/1972 Speed ..... A47C 29/006 5/505.1
3,919,949 A * 11/1975 Rendleman ..... B23Q 13/00 108/27
4,709,641 A * 12/1987 Lenger ..... A47B 13/081 108/102
4,732,089 A * 3/1988 Mueller ..... A47B 13/081 108/102
5,085,154 A * 2/1992 Merl ..... A47F 5/0093 108/61
5,144,898 A * 9/1992 Posly ..... A47B 23/046 108/148
5,290,058 A * 3/1994 Adams ..... A61G 7/0527 108/143
6,615,744 B1 * 9/2003 Eckstein ..... A47B 9/20 108/140
6,619,348 B2 * 9/2003 Wang ..... B23D 47/025 108/143
6,659,293 B1 * 12/2003 Smith ..... A47F 1/12 211/126.15
7,967,137 B2 6/2011 Fulbrook
8,082,857 B2 * 12/2011 George ..... G08B 25/008 108/50.01

(Continued)

*Primary Examiner* — Jose V Chen
(74) *Attorney, Agent, or Firm* — Sanchelima & Associates, P.A.; Christian Sanchelima; Jesus Sanchelima

(57) ABSTRACT

A sliding bedside tray including a tray assembly and a sliding rail assembly is disclosed. There is often a need for bedridden user's such as hospital patients to have their daily lives facilitated due to their circumstances. Often times these patients are not very mobile. Even as immobile as the patient may be there is often a need for them to care after themselves in the form of feeding or administering their medications. Importantly, the sliding rail assembly is mounted onto a surface, such as table. The sliding rail assembly is held in place with the use of clamps which allow for quick and easy assembling and disassembling on different surfaces thereof. The tray assembly is mounted onto the sliding rail assembly and is free to slide the distance that the sliding rail assembly allows. A user simply pulls the tray assembly towards themselves for easy access of items thereon.

19 Claims, 4 Drawing Sheets

(56) References Cited

U.S. PATENT DOCUMENTS

| | | | | |
|---|---|---|---|---|
| 8,100,061 | B2 * | 1/2012 | Hookway | A47B 23/046 108/50.01 |
| 8,316,777 | B1 * | 11/2012 | Rosing | A47B 23/046 108/49 |
| 8,424,472 | B2 * | 4/2013 | Fremming | A47B 37/00 108/143 |
| 9,505,069 | B2 * | 11/2016 | Frolov | B23D 47/025 |
| 2003/0029824 | A1 * | 2/2003 | Weiler | A47F 5/005 211/184 |
| 2018/0020848 | A1 * | 1/2018 | Mercier | A47F 5/005 108/61 |

* cited by examiner

SLIDING BEDSIDE TRAY

BACKGROUND OF THE INVENTION

1. Field of the Invention

The present invention relates to a sliding bedside tray and, more particularly, to a sliding bedside tray that is capable of assisting a user reaching and obtaining items held thereon the sliding bedside tray.

2. Description of the Related Art

Several designs sliding bedside trays have been designed in the past. None of them, however, include a tray having multiple compartments for holding items, such as medicine thereon, where the tray is attached to a surface, such as a hospital bed table, and the tray is movable to and from the patient with a pair of sliding rails. When a patient is bedridden due to an illness, disability or injury, the patient may have difficulty reaching and obtaining certain items in their surrounding area. One such important item may be medicines and medications. Often times the medications are to be administered daily, and with the help of the present invention the patient may be able to administer their own medications. This difficulty encountered by the patient may also make it so that the patient feels down on themselves. The present invention helps to enable a user such as a patient to reach necessary items with ease even if they are unable to move and maneuver themselves much.

Applicant believes that a related reference corresponds to U.S. Pat. No. 7,967,137 issued to Jason D. Fulbrook et al. for Organizer of Expendable Supplies for Medical Patients (OESMP). It is a tray organizer apparatus for safely organizing routine expendable medical supplies for in hospital patients disclosing a plurality of variants in the form of a non-power embodiment of a surface tray with shaped recesses for retaining medical supplies and power embodiments with 110*ac* volt supply with a multiplicity of 110 volt outlet and a plurality of USB ports, Firewall port, and other devices such as tiltable LED illuminated mirrors. However, it differs from the present invention because the Fulbrook reference attaches to surfaces at one side of the tray. It also includes spaces of predetermined shaped. The present invention can be retrofitted onto tables, such as bedside hospital tables. The present invention also includes a sliding mechanism that is not seen in the Fulbrook reference.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a sliding bedside tray that can be retrofitted onto all existing bedside surfaces and tables.

It is another object of this invention to provide a sliding bedside tray that facilitates accessibly of items, such as medicines, for persons that are not very mobile.

It is still another object of the present invention to provide has a simple configuration for ease of use by persons of all ages and sizes.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
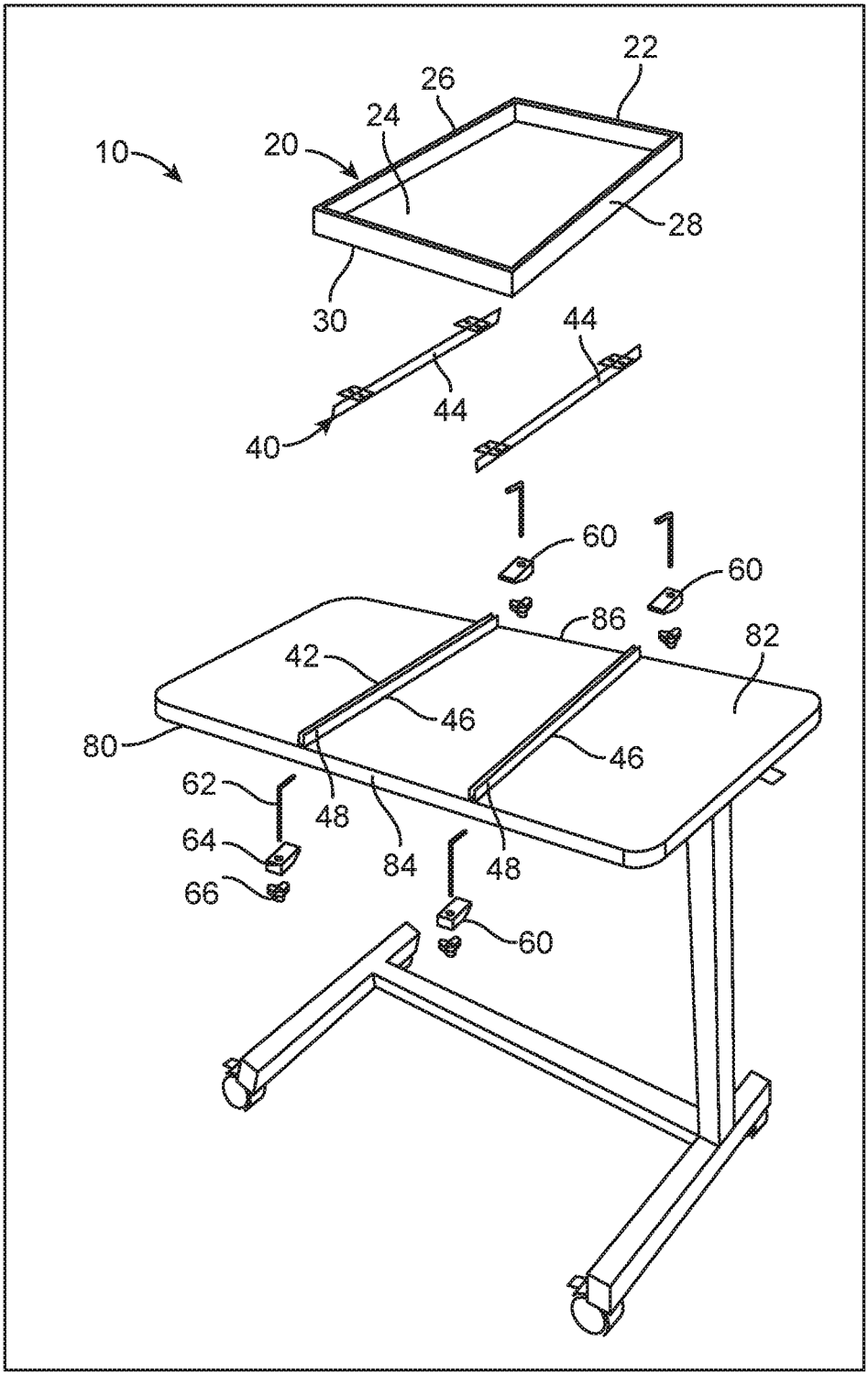
FIG. 1 represents an exploded view of the present invention.

Referring now to the drawings, where the present invention is generally referred to with numeral 10, it, a sliding bedside tray, can be observed that it basically includes a tray assembly 20, a sliding rail assembly 40 and clamps 60.

Figure 2:
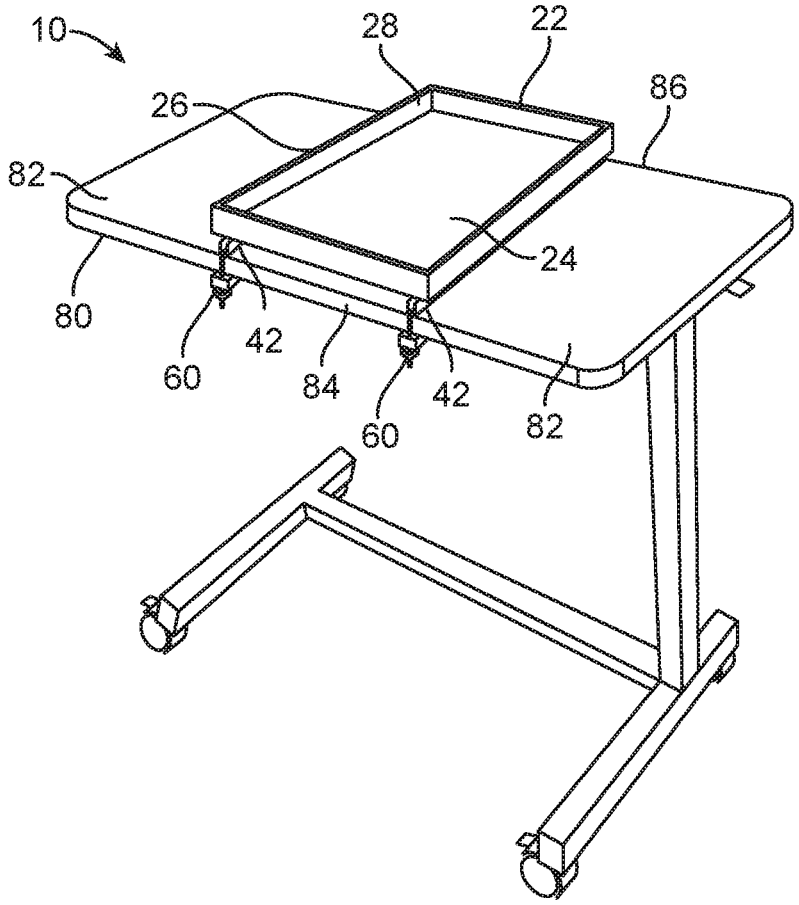
FIG. 2 is an isometric view of the present invention.
Figure 3:
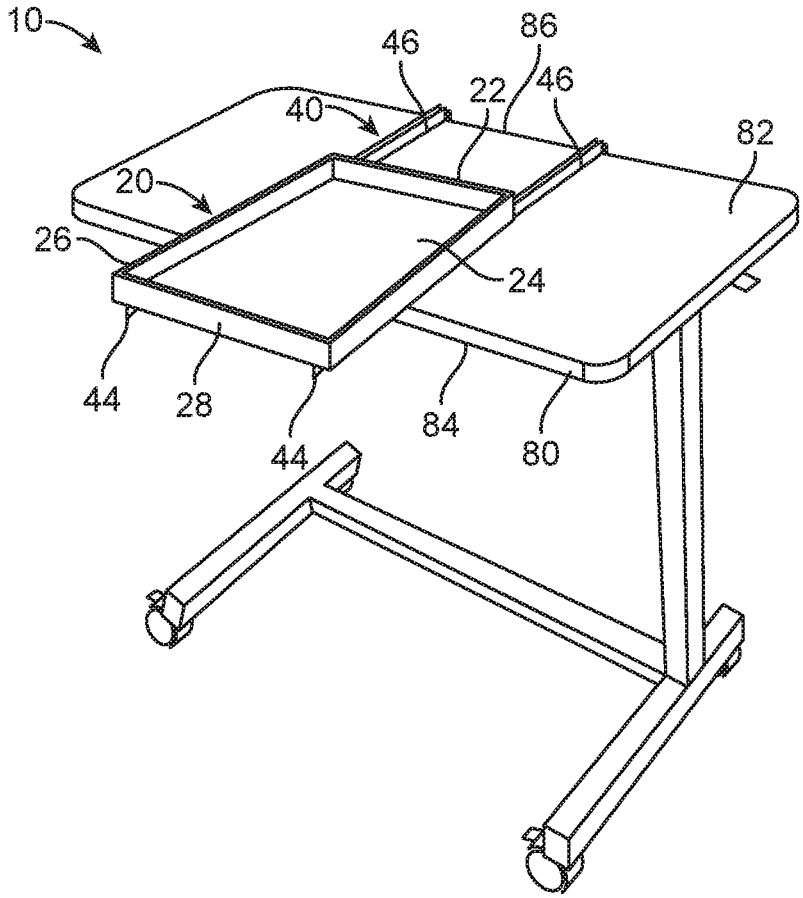
FIG. 3 shows an isometric view of the present invention mounted onto a table and sliding outwardly.
Figure 4:
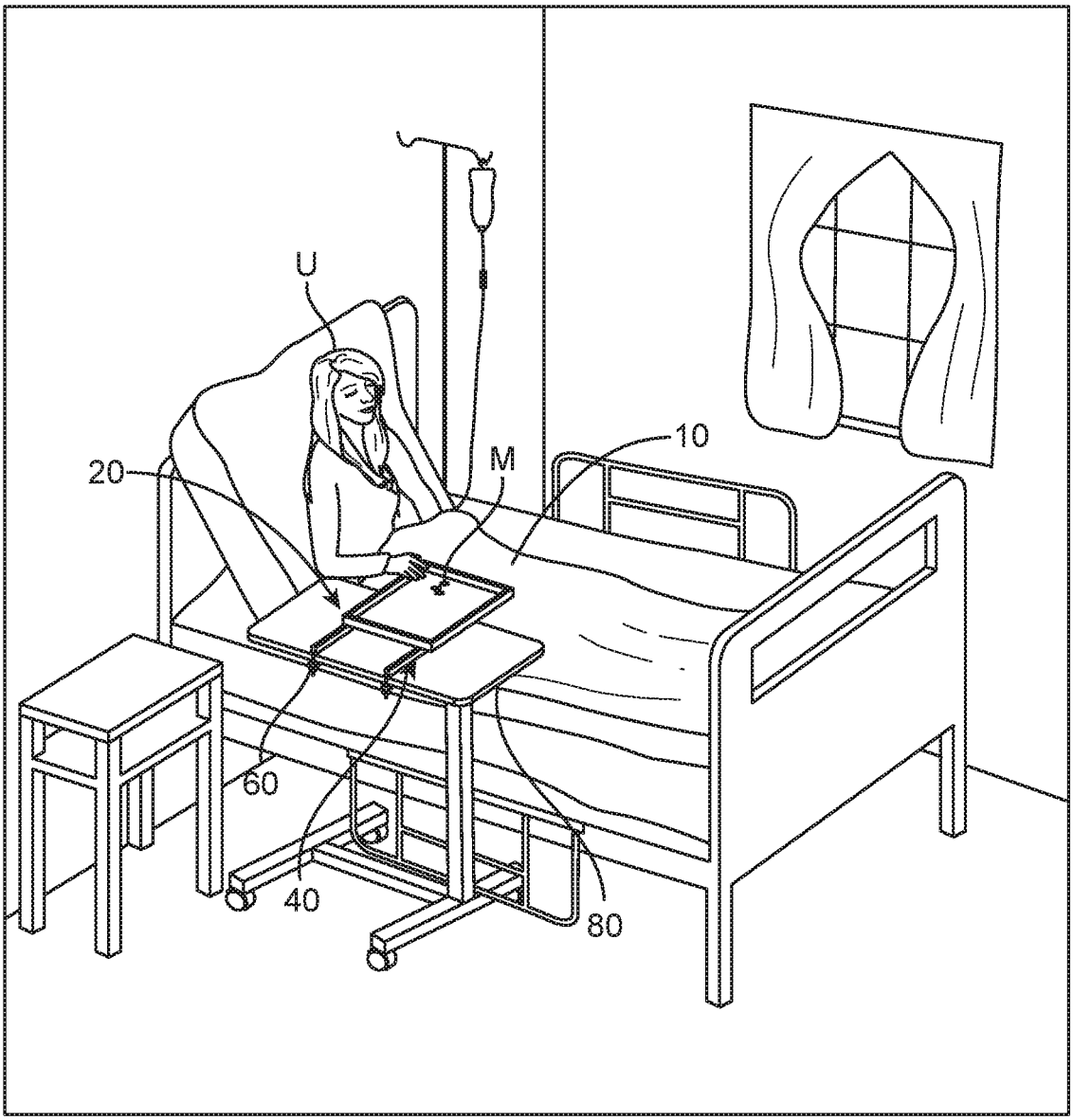
FIG. 4 illustrates the present invention in an operational setting in which the present invention is mounted to a hospital bedside table and is being used by a bedridden patient.

Referring to FIG. 1-4 sliding bedside tray 10 can be seen. Importantly, sliding bedside tray 10 includes tray assembly 20. Tray assembly 20 includes a tray 22. Tray 22 may preferably be rectangular shaped, however, virtually any other shape may be suitable for tray 22. Tray 22 may include a tray floor 24 which is adapted to receive and hold items thereon such as medications M. Tray floor 24 of tray 22 may function as a floor that is stable enough to hold and receive items and the weight of the items mounted thereon. Tray 22 may be made of wood, plastic, metal, rubber, aluminum or combinations thereof. Tray 22 may also have a perimeter 26. About perimeter 26 of tray 22 may be sidewalls 28 extending upwardly therefrom. In an alternate embodiment, sidewalls 28 may be extending upwardly from tray floor 24. It should be understood that shape and dimensions are not to be limiting as any predetermined shape and dimensions may be suitable for the present invention as per predetermined needs of a person. It may be suitable for tray 22 of tray assembly 20 to be of a dimension that cooperates with a table 80, more specifically with a tabletop 82 of table 80, in order for tray 22 to be mounted thereon. In an alternate embodiment, it may be suitable for tray 22 to include a plurality of dividers thereon. The dividers may be used to allow for better organizations of items such as medications M placed thereon tray 22. The dividers may include divider walls extending upwardly that create separation of the space on tray 22.

It can further be seen that sliding bedside tray 10 also includes sliding rail assembly 40. Sliding rail assembly 40 may further include at least one rail 42. In the immediate embodiment, it can be seen that the present invention includes two of at least one rail 42. However, it should be understood that any number of at least one rail 42 may be suitable for the present invention. Each of at least one rail 42 further includes an at least one rail male member 44 and an at least one rail female member 46. Preferably, at least one rail male member 44 may be fixedly mounted or attached onto a tray bottom side 30 of tray 22. In an alternate embodiment, at least one rail male member 44 may be removably mounted onto tray bottom side 30. At least one rail male member 44 may be attached to tray bottom side 30 with fasteners such as snap buttons, screws, nails, hook and loop straps, an adhesive or other fastening means as known in the art. While at least one rail female member 46 may be removably mounted onto tabletop 82 of table 80. At least one rail female member 46 is adapted to receive and hold at least one rail male member 44 therein. At least one rail female member 46 may function like a track for at least one rail male member 44. At least one rail male member 44 may slide along at least one rail female member 46 as at least one rail male member is slidably movable about said at least one rail female member 46. At least one rail female member 46 may extend along a length of tabletop 80. Preferably, at least one rail female member 46 may extend from a first end 84 to a second end 86 of table 80. In an alternate embodiment it may be suitable for at least one rail female member to extend across or be oriented on tabletop 82 vertically, horizontally or diagonally. Meaning it may also be suitable for tray 22 to be oriented vertically, horizontally or diagonally on or across tabletop 82. In order for rail female member to be removably attached onto tabletop 82 clamps 60 may be used. Clamps 60 may include a threaded portion 62, a table securing portion 64 and a fastener knob 66 underneath table securing portion 64. Threaded portion 62 may be a predetermined length and may be hook shaped at a top end. The top end of threaded portion 62 may be fixedly mounted to at least one rail female member 46 at front and rear side thereof with fasteners as known in the art. Fastener knob 66 may be used to move up and down threaded portion 62. Fastener knob 66 may include a through hole adapted to receive threaded portion 62 therethrough. Rotation of fastener knob 66 upwardly on threaded portion 62 may cause upward movement of table securing portion 64 until a bottom surface of tabletop 82 is reached to secure clamps 60 in place. Releasing of fastener knob 66 or downward movement of fastener knob 66 may cause table securing portion 64 to release table 80 for quick and easy removal of the present invention from table 80. At least one rail female member 46 may be secured onto tabletop 82 by being held in place with clamps at each end located at first end 84 and second end 86. In an alternative embodiment, it may be suitable for means other than clamps 60 to be used in order to secure at least one rail female member 46 onto tabletop 82. It should be understood that at least one rail male member 44 is received in at least one rail female member 46 and at least one rail male member 44 slides along at least one rail female member 46. At least one rail male member 44 may extend beyond at least one rail female member 46 up until a rail cross section 48 is met. Rail cross section 48 is the limit at which at least one rail male member 44 may extend beyond at least one rail female member 46. At rail cross section 48 a portion of rail at least one male member 44 and at least one rail female member 46 are still in contact with one another. Each of at least one rail 42 may have an open and closed configuration. In the open configuration of at least one rail 42, at least one rail male member 44 hangs over the edge of tabletop 82 and as well as over the edge of at least one rail female member 46. In the closed configuration of at least one rail, at least one rail male member 44 and at least one rail female member 46 are aligned with one another.

It should be understood that sliding rail assembly 40 may be mounted to tray assembly 20. Sliding bedside tray 10 may be mounted onto any surface but preferably to table 80 such as a hospital bedside table. Once a patient needs access to their medications M located on tray 22 atop of table 80, the patient may pull tray assembly 20 towards themselves, to achieve an open configuration, for easy access of the items such as medications M mounted thereon tray assembly 20. Once the patient has accessed their medications M, the patient may simply slide tray assembly 20 back towards second end 86 of table 80 to achieve the closed configuration. It can be seen in FIG. 4, how a user U reaches to grab medications M once the present invention has slid towards them. It should be understood that the present invention is not to be limited by dimensions, shape, color or materials. It may be suitable for dimensions, shape, color or materials to be changed and modified as per the needs of user U.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a sliding bedside tray, comprising:

a. a table having a tabletop, a first end and a second end;

b. a tray assembly including a tray, said tray having a tray floor, a perimeter, side walls and a tray bottom side, said side walls extending upwardly from said tray floor entirely about said perimeter of said tray creating a border entirely about said tray floor;

c. a sliding rail assembly including at least one rail, said at least one rail being entirely underneath of said tray, said at least one rail further defined as at least one rail male member mounted entirely under said tray at said tray bottom side and at least one rail female member mounted atop of said tabletop;

d. clamps, wherein each of said clamps includes a threaded portion, a table securing portion and a fastener knob, said threaded portion further defined by a shaft portion and a head portion, said head portion being perpendicularly secured to a top distalmost end of said shaft portion;

e. said at least one rail female member extending from said first end to said second end of said tabletop of said table, said at least one rail female member secured to said tabletop with said clamps at said first end and said second end of said tabletop of said table, said head portion being received within each of said at least one rail female member, said shaft portion extending downwardly below said tabletop from said head portion, said table securing portion secured to said shaft portion entirely underneath of said tabletop with said fastener knob, said tabletop sandwiched between said head portion and said table securing portion, said at least one rail male member slidably moveable along said at least one rail female member to move said tray towards and away from said tabletop.

2. The system of claim 1, wherein said tray is one of a shape that cooperates with the shape of said tabletop.

3. The system of claim 1, wherein said at least one rail female member is removably mounted to said tabletop.

4. The system of claim 1, wherein said tray receives and holds medications within said tray atop of said tray floor.

5. The system of claim 1, wherein said at least one rail male member is fixedly mounted to said tray bottom side of said tray.

6. The system of claim 1, wherein said at least one rail female member is secured to said tabletop by hook and loop straps, screws, buttons, snap buttons, adhesives, or nails.

7. The system of claim 1, wherein said table is a bedside hospital table.

8. The system of claim 1, wherein said tray is made of wood, plastic, metal, aluminum, rubber or combinations thereof.

9. The system of claim 1, wherein said tray is rectangular shaped.

10. The system of claim 1, wherein each of said at least one rail female member is oriented vertically, horizontally or diagonally across said tabletop.

11. The system of claim 1, wherein said tray is oriented vertically, horizontally or diagonally across said tabletop.

12. The system of claim 1, wherein said fastener knob rotatably moveable up and down said threaded portion, a upward movement of said fastener knob moving said table securing portion upwardly towards said tabletop, a downward movement of said fastener knob releasing said table securing portion from said at least one rail female member to release said at least at least one rail female member from said tabletop.

13. The system of claim 1, wherein said at least one rail includes a rail cross section, said rail cross section being a limit at which said at least one rail male member can extend beyond at least one rail female member when each of said rail male member is slid away from each of said rail female member.

14. The system of claim 1, wherein each of said rail male member and each of said rail female member have a same length as said tabletop.

15. The system of claim 1, wherein said fastener knob secures said table securing portion entirely from underneath of said table securing portion.

16. The system of claim 1, wherein said fastener knob securing said table securing portion in constant abutting contact with a bottom of said tabletop.

17. The system of claim 1, wherein said fastener knob has a triangular star configuration.

18. The system of claim 1, wherein said table securing portion extends a partial length of said tabletop.

19. A system for a sliding bedside tray, consisting of:

a. a table having a tabletop;

b. a tray assembly including a tray with sidewalls extending entirely about a perimeter of said tray creating a border entirely about said tray;

c. a sliding rail assembly including at least one rail, said at least one rail being entirely underneath of said tray, said at least one rail further defined as at least one rail male member mounted entirely under said tray and at least one rail female member mounted atop of said tabletop, said at least one rail male member being received into said at least one rail female member from above;

d. clamps, wherein each of said clamps includes a threaded portion, a table securing portion and a fastener knob, said threaded portion further defined by a shaft portion and a head portion, said head portion being perpendicularly secured to a top distalmost end of said shaft portion;

e. said at least one rail female member extending from said first end to said second end of said tabletop of said table, said at least one rail female member secured to said tabletop with said clamps at said first end and said second end of said tabletop of said table, said head portion being received within each of said at least one rail female member, said shaft portion extending downwardly below said tabletop from said head portion, said table securing portion secured to said shaft portion entirely underneath of said tabletop with said fastener knob, said tabletop sandwiched between said head portion and said table securing portion, said at least one rail male member slidably moveable along said at least one rail female member to move said tray towards and away from said tabletop, said fastener knob rotatably movable along said shaft portion to secure said table securing portion in constant abutting contact with a bottom of said tabletop.

* * * * *